US008047977B2

(12) United States Patent
Lauenstein et al.

(10) Patent No.: US 8,047,977 B2
(45) Date of Patent: Nov. 1, 2011

(54) FILTER, SMOKING ARTICLES CONTAINING THE SAME, FILTER STRANDS AND METHODS AND DEVICES FOR PRODUCING FILTERS AND SMOKING ARTICLES OF THIS TYPE

(75) Inventors: Michael Lauenstein, Cormondrèche (CH); Dante M. Boido, Neuchâtel (CH); Reynald M. Aeschlimann, Corcelles (CH)

(73) Assignee: Philip Morris USA Inc., Richmond, VA (US)

( * ) Notice: Subject to any disclaimer, the term of this patent is extended or adjusted under 35 U.S.C. 154(b) by 2048 days.

(21) Appl. No.: 10/498,625

(22) PCT Filed: Dec. 10, 2002

(86) PCT No.: PCT/EP02/13991

§ 371 (c)(1), (2), (4) Date: Jan. 31, 2005

(87) PCT Pub. No.: WO03/049560

PCT Pub. Date: Jun. 19, 2003

(65) Prior Publication Data

US 2005/0115578 A1 Jun. 2, 2005

(30) Foreign Application Priority Data

Dec. 11, 2001 (DE) ..... 101 60 672

(51) Int. Cl.

| | |
|---|---|
| ***B31C 99/00*** | (2009.01) |
| *A24B 15/00* | (2006.01) |
| *A24D 3/06* | (2006.01) |

(52) U.S. Cl. ..... 493/47; 493/42; 493/50; 131/331; 131/341; 131/342; 131/344; 131/345

(58) Field of Classification Search ..... None
See application file for complete search history.

(56) References Cited

U.S. PATENT DOCUMENTS

| | | | | |
|---|---|---|---|---|
| 3,354,887 | A | 11/1967 | Hall | |
| 3,547,009 | A | 12/1970 | Molins | |
| 3,715,957 | A | 2/1973 | Hall | |
| 4,116,602 | A * | 9/1978 | Hall | 425/354 |
| 5,069,231 | A * | 12/1991 | Rutherford | 131/335 |
| 5,787,902 | A * | 8/1998 | Shepherd et al. | 131/331 |

FOREIGN PATENT DOCUMENTS

| | | |
|---|---|---|
| DE | 1 782 352 | 8/1971 |
| DE | 2 164 824 | 7/1972 |
| DE | 42 06 510 | 9/1993 |

OTHER PUBLICATIONS

Wikipedia contributors, "Cigarette," Wikipedia, The Free Encyclopedia, http://en.wikipedia.org/w/index.php?title=Cigarette&oldid=224391609 (accessed Jul. 9, 2008).*

* cited by examiner

*Primary Examiner* — Richard Crispino
*Assistant Examiner* — Michael J Felton
(74) *Attorney, Agent, or Firm* — Connolly Bove Lodge & Hutz LLP

(57) ABSTRACT

The invention relates to a filter (10) for tobacco products with a first terminal filter element (12), a second terminal filter element (14), a middle filter element (16) which is located between first and second terminal filter element and contains a granular filter material, and a casing (20), one part of one of the terminal filter elements (12) being displaceable vis-à-vis the casing (20). The invention furthermore relates to smoking articles with such filters, filter strands with two or more of the filters, and processes and devices for the production of such filters and tobacco products.

4 Claims, 4 Drawing Sheets

Figure 1:
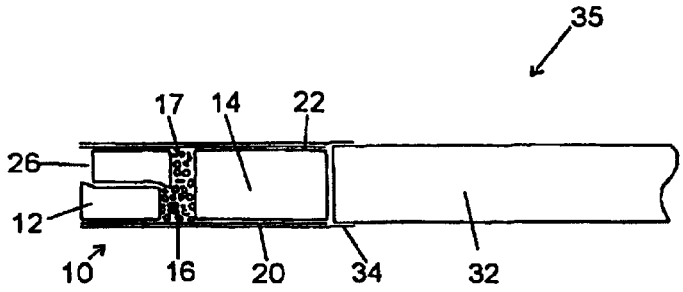

FILTER, SMOKING ARTICLES CONTAINING THE SAME, FILTER STRANDS AND METHODS AND DEVICES FOR PRODUCING FILTERS AND SMOKING ARTICLES OF THIS TYPE

The present invention relates to filters for tobacco products with a first terminal filter element, a second terminal filter element, a middle filter element, which is located between the first and second terminal filter elements and contains a granular filter material, and a casing, tobacco products produced with this filter, in particular cigarettes, filter strands of two or more of the filters, and processes and devices for the production of the filters and tobacco products.

Such filters are widely used for tobacco products such as cigarettes and are called plug-space-plug filters (PSP filters) or chamber filters.

PSP filters are as a rule produced not by the cigarette manufacturer but by a supplier. To this end, mouth-side and tobacco-side filter rods are positioned on the casing, the terminal filter rods having a length corresponding to the length of the filter element in the finished filter, the internal filter rods each having double the length of the corresponding filter elements in the finished filter. A cavity, into which the granular material is then poured, always remains between a mouth-side and a tobacco-side filter rod. The casing is then sealed and glued to the filter rods. The product produced by the supplier is therefore not a single filter, but at first a continuous filter strand which is normally cut into strands with 4 or 6 single filters, which are connected together to the strand, and dispatched in this form.

During the cigarette production, this filter strand is then first cut into double filters. These are provided on both sides with a tobacco strand and then the finished cigarette, in each case with a PSP filter, is obtained by cutting through the middle.

A problem with such PSP filters is the complete filling of the middle chamber.

The granular material of the middle filter element is as a rule activated carbon which, as is also the case with other granular materials, when filling the middle chamber, does almost completely fill the latter. However, during the subsequent handling of the filter strand on the supplier's premises, the friction caused by the rubbing against each other of individual activated-carbon particles (or other granular materials), which have an uneven surface and grain-size distribution can lead to minor splintering, as a result of which the individual particles are packed more tightly. Independently of this, the movement of the strand is in itself enough to produce a greater packing density of the particles. Both effects are also greatly increased by the transport of the filter strand, and the final result in the finished cigarette is that the middle filter element has an incomplete fill level, as a rule only approx. 70-95%. If the cigarette is held level then there is a free channel, through which the smoke stream then preferably travels, in the upper area of the central element. Any function of the granular material in the middle element, such as for example a filter effect, is therefore lost. The drawing resistance of the cigarette will also vary, depending on whether the cigarette is held horizontal or level when smoking.

Overfilling of the middle chamber to compensate for the later loss in volume of the granular material has for its part the disadvantage that the granular filter material is thereby forced into the neighbouring filter elements and contaminates these, impairing their level of effectiveness and the visible quality.

In order to obtain a complete filling of the middle element with granular material, U.S. Pat. No. 3,807,286 describes the application of a vacuum opposite the filling position for the granular material. Alternatively, an increase in the packing density can be achieved by shaking before the filling process is complete. In both ways the negative effects described above can be slightly reduced, however this does not solve, in particular, the problem of the friction and the increase in packing density resulting from the transport of the filter strands.

It is also known for filter cigarettes with multiple or chamber filters that single filter elements of the multiple or chamber filters can be moveable and displaceable. The displacement of single filter elements serves on the one hand to adjust the ventilation or vary the taste of the cigarette. U.S. Pat. No. 4,319,590 for example describes a cigarette with a double filter, the two filter elements of which can be removed by pulling on a cord. Depending on whether the cigarette is smoked with both filter elements, only with one filter element or optionally only with one element provided with flavouring, so the strength and the taste of the cigarette varies. U.S. Pat. No. 4,433,696 discloses a chamber filter cigarette the mouth-side filter element of which is fixed while the tobacco-side filter element is moveable. If it is located wholly against the tobacco column, then there is a void between the two filter elements. This can be reduced by knocking the mouth end on a hard object, whereby the tobacco-side filter element slips towards the mouth-side filter element and ventilation holes in the lining paper are covered. Ventilation is therefore adjusted in this way. In U.S. Pat. No. 4,649,944 this effect is again achieved in the case of a chamber filter cigarette by displacing the mouth-side filter element towards the tobacco-side filter element, which can result in ventilation holes in the lining paper being covered or freed. There may also be flavour-producing agents in the cavity between the two filter elements. These contain encapsulated flavourings. The pressure produced by the advanced mouth-side filter element causes the capsules to break open and the flavourings are released.

On the other hand, PSP filters with which one of the terminal filter elements is displaced towards the middle filter element in order to achieve a complete filling of the middle chamber are known from DE-OS 28 18 328 and DE-OS 17 82 352. Furthermore a device for the production of such PSP filters is known from DE-OS 21 64 824. Problematic with the PSP filters of the state of the art named here is that the displaced filter element has the tendency to return to its original position. To avoid this, DE-OS 17 82 352 proposes for example the application of an adhesive to the internal surface of the outer casing, which is activated by heating after the displacement of the filter element so that the displaced filter element is fixed.

The object of the present invention is therefore to make available a PSP filter of the type named with high packaging density and as large as possible, preferably a complete fill level in the middle element, wherein a simple fixing of the displaced filter element is to be possible. It is furthermore the object of the invention to produce filter strands which are built up from these PSP filters, tobacco products which contain these PSP filters, and processes and devices for the production of the filters, filter strands and tobacco products.

This object is achieved by a filter for tobacco products with a first terminal filter element, a second terminal filter element, a middle filter element, which is located between the first and the second terminal filter elements and contains a granular filter material, and a casing, characterized in that (only) one part of one of the terminal filter elements is displaceable vis-à-vis the casing.

The displaceability of only one part of the terminal filter elements vis-à-vis the casing and axially towards the middle filter element has the advantage on the one hand that a reduction in volume of the granular filter material occurring during the production and the transport of the filter strand is compensated for by the displacement of the tobacco-side filter element and thus the middle filter element is completely filled with granular material, so that formation of a channel and diversion in the middle filter element are not possible. On the other hand, as a result of the expansion of the displaced and non-displaced part of the filter element, which takes place automatically, the displaced part is fixed automatically.

The terminal filter elements are either one (or more) filter plugs, which have a core (preferably with round cross-section) and an outer ring surrounding the core, the core (and thus a part of the terminal filter elements) being displaceable vis-à-vis the outer ring. The terminal filter elements are thus preferably a concentric filter. Or else the terminal filter elements are divided into two or more parts, preferably into two parts along their longitudinal axes or also parallel thereto such that in turn only one part of the terminal filter element can be displaced towards the central element, whilst the other part of this terminal filter element preferably adheres to the outer casing and is therefore immovable.

As the filter plug lies against the outer casing or the core against the outer ring under at least slight pressure, a displacement of one part of the filter plug towards the middle filter element is possible. When using a concentric filter as displaceable terminal filter element the fixing is achieved by an expansion of the projecting outer ring and the displaced core. With terminal filter elements divided into two or more parts, for example with filter elements divided into two parts along the longitudinal axis, one of the two parts is displaced towards the central element. The projecting parts can then expand into the cavity produced by the displacement and thus impede a sliding back of the displaced element into the starting position.

Preferably only one of the two terminal filter elements is partly displaceable vis-à-vis the casing, and the other of these two filter elements is then securely connected to the outer casing, for example at least partly glued, so that a displacement of this other terminal filter element is not possible.

The effect of the displacement of the displaceable terminal filter element is that the granular material completely fills the chamber in the middle of the filter. If the finished filter is held level, the entire cross-section of the middle filter element is therefore filled and no channel exists at the top. The casing will then (provided it has not been cut by the manufacturer) project over the displaceable terminal part filter element or the outer ring over the core of the displaceable terminal filter element so that the filter with the recess at the one end is a recess filter.

The granular material of the middle filter element can be formed by any solid filter materials which have more or less harmonic geometric forms and a grain-size distribution of 200 to 100 μm, preferably from 400 to 600 μm. The granular material will preferably be activated carbon with a grain-size distribution of 400 to 600 μm. Further examples of granular filter materials are silica gel (activated or not activated) with a grain-size distribution of preferably 300 to 700 μm or sepiolite with a grain-size distribution of preferably 400 to 600 μm. Mixtures of the named materials can of course also be used. (The granular materials are not to include the flavour-producing agents described above in connection with U.S. Pat. No. 4,649,944, i.e. capsules which contain one or more flavourings and/or aromatics).

The terminal filter elements can be made from the customary filter materials for tobacco products, such as e.g. acetate, paper, in particular crepe paper, cellulose or cotton wool. As a rule, the two terminal filter elements (unlike the middle filter elements) will be enclosed on their circumference, but not at their end-surfaces, in a separate wrapping which as a rule is air-permeable and optionally perforated, so that this separate wrapping comes to lie in the finished filter between the terminal filter elements and the outer casing.

As a rule, the terminal filter elements and the middle filter element have the same diameter, which for example for cigarettes is approx. 5 mm to 9 mm, in particular 8 mm. The length of the terminal filter elements is approx. 3 to 15 mm, preferably 6 to 10 mm and in particular approx. 7.5 mm, the length of the middle filter elements 6 to 14 mm, preferably 8 to 12 mm and particularly approx. 10 mm. The two terminal filter elements preferably have the same length. The middle filter element, when completely or almost completely full, as a rule accounts for 20-60%, preferably 30-50% and in particular approx. 40% of the overall length of the filter, the terminal filter elements together 20-50%, preferably 25-35% and in particular approx. 30%. The recess formed by the displacement of a terminal filter element normally has a length of 0.1 to 6 mm, preferably approx. 2 mm, the length of the recess corresponding to the reduction in length of the middle filter element resulting from the displacement. The overall length of the filter is 20 to 40 mm, in particular approx. 32 mm.

Each of the terminal filter elements consists as a rule of a single filter plug or concentric filter. However, two or more filter plugs or concentric filters or combinations are of course also possible, for example a first terminal filter element, consisting of two single filter plugs, and a second terminal element, consisting of a concentric filter.

The outer casing of the filter is as a rule an air-permeable and optionally perforated thin paper with for example 1000 Coresta units to 25000 Coresta units.

The invention furthermore relates to a filter strand with two or more of the filters described above. According to the production of the filter strands described in the introduction, the terminal filter rods have the length of a tobacco- or mouth-side filter element of the finished filter. The inner filter rods then each have double the length of the tobacco- or mouth-side filter elements of the finished filter. After filling with the granular material and sealing the outer casing, the latter is glued with the filter rods and preferably only with one of the terminal filter elements, such that the other of the terminal filter elements can be partly displaced in axial direction. This means in particular that, so long as concentric filters are used for the displaceable terminal filter elements, the outer ring can also be glued to the outer casing, as the central core is then still displaceable vis-à-vis the outer ring. The strand which forms during initial cutting then contains several single filters, preferably 2, (preferably with the displaceable filter elements on the outer ends of the strand), 4 or 6, which are obtained during the later processing by cutting the filter rods through the middle with double the length of the later mouth- or tobacco-side filter elements. The single filters are therefore in each case aligned in opposition in the filter strand and connected either via their later mouth-side or tobacco-side filter elements.

Basically, it is already possible in this stage of the production that one or both terminal filter elements, as long as they can be displaced, are partly displaced by the strand manufacturer towards neighbouring middle filter elements, so that the granular material of these two outer middle filter elements fills the entire cross-section of these middle filter elements in the level state and the casing projects over the outer part filter elements or, if concentric filters are provided, the outer rings project over the cores. This has the advantage that an inadvertent displacement of the outer displaceable filter elements in the wrong direction, and thus a possibly complete falling out in the event of greater stress being exerted on the granular filter elements, is avoided.

For the manufacture of tobacco products, in particular cigarettes, the middle filter strands are cut into double filters by the cutting through the middle of the filter rods with double the length of the mouth- or tobacco-side filter elements. Such double filters are also the subject of the present application and have for example outer filter elements, which are the tobacco-side and displaceably housed filter elements in the later finished filter. The outer filter elements are each followed by a middle filter element which is filled with the granular material, and finally in the middle a filter rod with double the length of a terminal filter element. In the manufacture of classic tobacco products, in particular cigarettes, a tobacco column, in the case of cigarettes a tobacco column wrapped in customary cigarette paper, is attached to such double filters on both sides, and the double filter and the filter-side end of the tobacco column is wrapped in a lining sheet (tipping paper) and joined, as a rule glued. The finished cigarettes are obtained by cutting through the middle of the double filter, and are then packed in the normal way.

The present invention relates furthermore to an addition to the known manufacturing process, in which, in the case of double filters which have displaceable filter elements at their two ends, force is exerted on these terminal filter elements and they are displaced towards the neighbouring middle filter elements. Through this displacement of the outer part filter elements the granular filter material of the middle filter elements is compacted, so that preferably the middle filter elements are completely filled. The force necessary for this is approx. 1 to 3 N, preferably 2 N for a normal cigarette filter diameter of approx. 8 mm.

After the outer filter elements are displaced towards the neighbouring middle filter elements, a tobacco strand is attached on both sides according to the normal process and the double filter is wrapped in lining paper and glued, and the product is then divided through the middle so that two finished tobacco products, in particular cigarettes, result, which have a recess between the filter and the tobacco column. Insofar as the tobacco-side part filter element is displaced, the outer casing together with the lining sheet should offer sufficient stability so that the outer casing is not dented when using the cigarette. When using concentric filters for the tobacco-side filter elements this danger is reduced further by the stabilising outer ring.

Alternatively a process is of course also conceivable in which firstly the double filter with the displaced outer ends is cut through the middle and these are then connected at the ends with the displaced filter element individually with a tobacco column via a lining sheet.

If however, the double filters have the displaceable terminal elements inside the double filter and not on the outer ends, this double filter is first divided through the middle. The single filter obtained is then connected to the tobacco column as normal via a lining sheet at the side of the single filter which does not have the displaceable terminal filter element. The product obtained can then be packed without further processing and prepared for sale.

The consumer can then, directly before use, ensure the required complete filling of the middle chamber by pressing on the mouth-side filter element. Alternatively, the mouth-side filter element can however also be displaced partly towards the middle chamber by the manufacturer and the obtained cigarette packed only then. The product of this process is then a cigarette with a mouth-side recess. This has the advantage that, should a small reduction in volume of the granular filter material of the inner chamber recur during packaging, transport or use, this can be compensated for by the consumer by a supplementary advancing of the partly displacable mouth-side filter element.

The process described above according to the invention for partly displacing terminal filter elements from double filters can be carried out with a first device, characterized by a drum which is arranged rotatably on a support and has, arranged on its circumference at a distance from the rotational axis, at least one, but preferably more, for example 9 to 15 and in particular 12, receptacles for a double-filter strand with partly displaceable (but not displaced) terminal filter elements on the outer ends of the double filter, and characterized by at least one, preferably two disks, which are arranged rotatably about an axis inclined relative to the axis of the drum and next to the drum, and in each case have, at a distance from their rotational axis, at least one, but preferably more, tampers so that, with the same rotation of the drum and the disk, the tamper moves, relative to the drum, essentially only parallel to the rotational axis of the drum. In order to avoid a discrepancy in the rotary movements of drum and disk or disks, the drum has axial projections which engage in corresponding recesses of the disk or disks so that the motion of the drum is transmitted automatically to the disk(s) and the latter always run synchronously with the drum. (A synchronised movement of drum and disk(s) can also be achieved by toothed edges on drum and disk(s)). The device described above is suitable not only for the production of filter elements with which one part of the terminal filter element is displaced, but also for the filter elements known from DE-OS 17 82 352 and DE-OS 28 18 328 with which the terminal filter element is displaced completely towards the central element.

The diameter and/or the size of the tamper is thus matched to the diameter and/or the size of the terminal displaceable filter elements, i.e. for example the diameter of the tamper is greater if the filter element on the outer ends of the double filter is a filter plug, and smaller if the filter element on the outer ends of the double filter is a concentric filter with a displaceable core.

The device preferably has a disk on both sides of the drum, both disks being inclined at the same angle but in opposite directions to the rotational axis of the drum. This has the advantage that, for double filters, which have two displaceable terminal filter elements, these two filter elements are displaced towards the neighbouring middle filter elements in one operation. Conversely, if a device with only one disk is used, then the opposite end has to be operated separately.

Upon rotation of the drum and the parallel running rotary movement of the preferably two allocated disks, due to the axes of the disks being inclined relative to the axis of the drum, the tampers will come into contact with the terminal filter elements. As the movement of the drum and of the disks continues, the contact of the tampers with the terminal filter elements will slowly decrease due to the angle of the rotational axis of the disks and of the rotational axis of the drum and after the drum has rotated by 180°, the distance between tamper and double filter is the greatest possible, with terminal filter elements (and tobacco-side in the finished product) now (e.g. partly) displaced towards the middle filter elements. At this point, the double filters can be transferred to a following drum and be further processed in the normal way, while, following the transfer, a new, unprocessed double filter can be conveyed into the freed holder of the drum. As the movement of the drum and the disk continues, the tampers will slowly come into contact with the new double filter, the smallest distance between the tampers being reached after renewed rotation by 180°, and then the (e.g. partly) advancing of the terminal filter elements of the double filter located in between will be completed.

The tampers can be connected securely to the disk circumference, for example screwed on, the number of tampers as a rule corresponding to the number of recesses for housing the double filters on the drum. To avoid damaging the outer ends of the tobacco filters, the tampers can however also be elastically connected to the disk. For this, for example, the outer edge of the disk can then be manufactured from a spring sheet onto which the tampers are screwed.

In an alternative version, instead of the at least one disk in the above-described device, at least one cam can be provided. This moves parallel to the drum which carries the double filter. Due to the change in diameter of the cam, a spring leaf which carries a tamper on its circumference is moved back and forth. Through this back- and forth-movement the outer tobacco-side filter elements are displaced towards the central filter elements.

This alternative device preferably has two cams which are mounted on both sides of the drum. In the area of the point of their greatest diameter the cams preferably have air nozzles through which an air-jet is guided onto the spring leaf. Two or three rows of air nozzles are preferably provided. The air-jet directed onto the spring leaf then makes possible a friction-free procedure.

The above-described process according to the invention for the production of a cigarette, the mouth-side filter element of which is partly displaced towards the middle chamber, can be carried out with a second device which is similar to the first device described above, but which instead of the second disk has a retaining device which is arranged next to the drum and opposite the disk, but otherwise corresponds to the above-described first device also as regards the preferred versions. (This device is also suitable not only for the production of filter elements with which one part of the terminal filter element is displaced, but also for the filter elements known from DE-OS 17 82 352 and DE-OS 28 18 328 with which the terminal filter element is displaced completely towards the central element.) On the drum, one or more cigarettes with filters, the mouth-side filter element of which is (e.g. partly) displaceable, but not yet displaced at the beginning of the process, are therefore fixed in receptacles. Upon the rotary movement of the drum and the parallel-running rotary movement of the allocated disk due to the angle of inclination between the axes of the drum and the disk, the tamper will once more come into contact with the terminal filter element. This is again (and e.g. only partly) advanced towards the middle filter element as the movement continues. The necessary counterpressure is generated by the retaining device, which is preferably a disk arranged coaxially to the axis of the drum, so that the cigarette remains fixed and the pressure exerted by the tamper leads to the displacement of the mouth-side filter element. In a similar way to the first device described above, here also, as the rotary movement continues, the tamper can move out of the recess of the filter again and the finished filter cigarette then be forwarded for further processing.

An embodiment of the invention is represented in the drawing and is described in more detail in the following.

Figure 2:
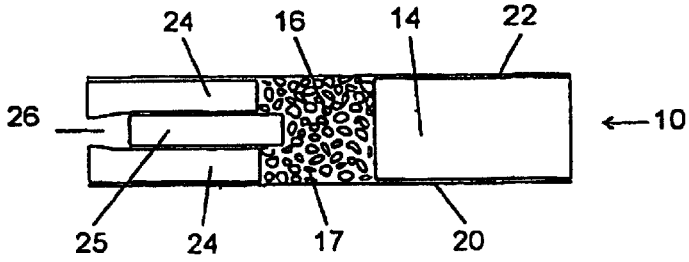
Figure 3:
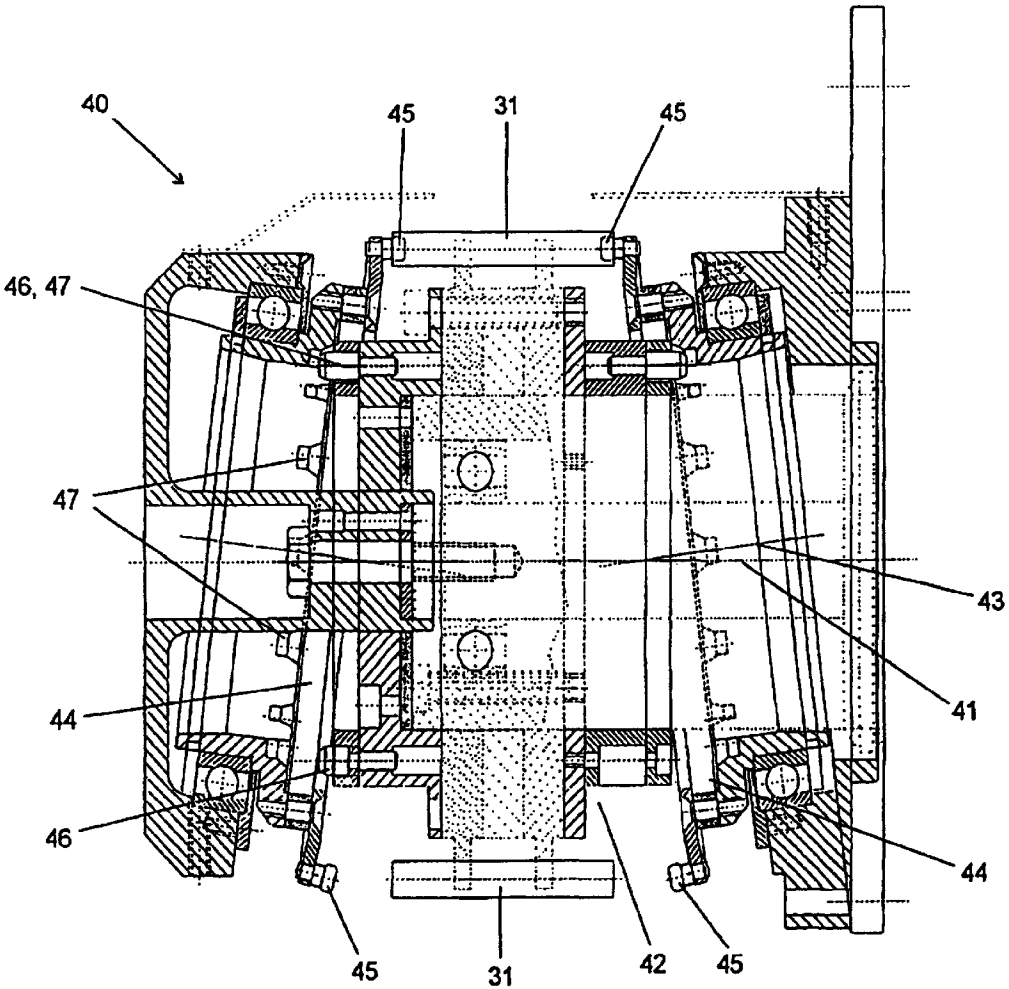
Figure 4:
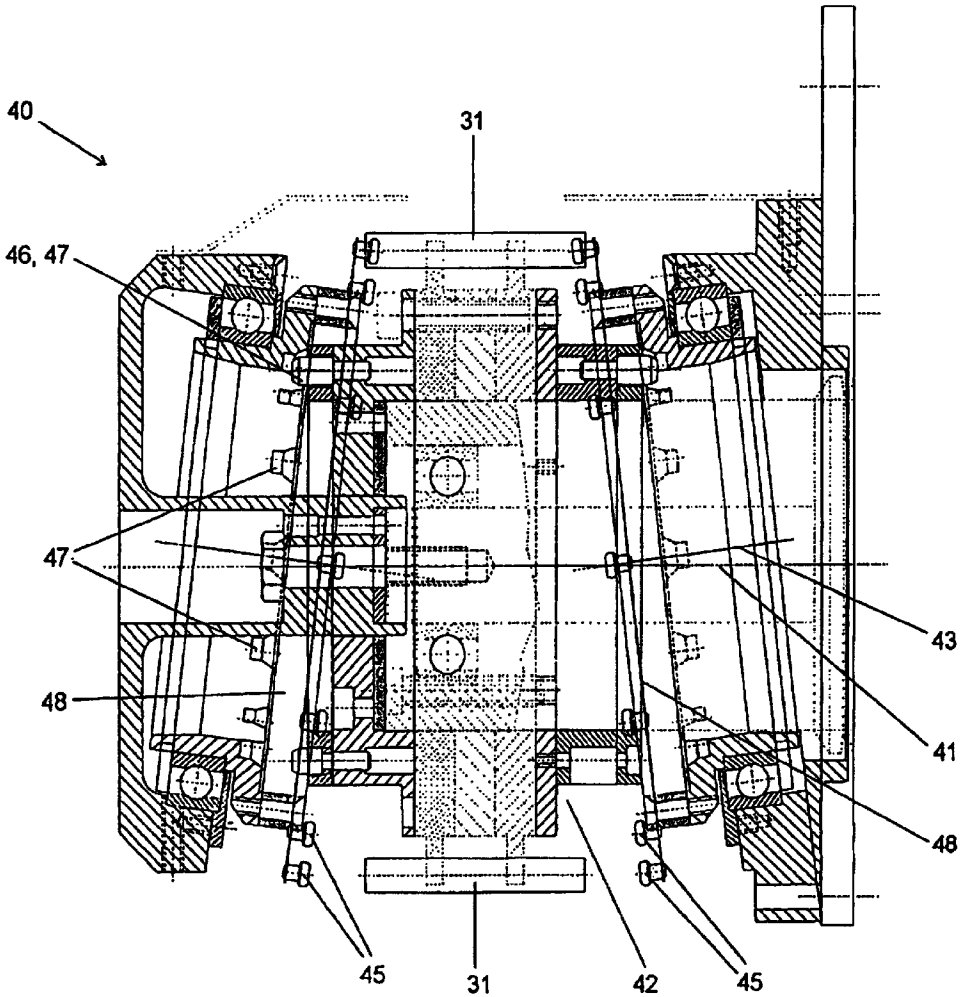
Figure 5:
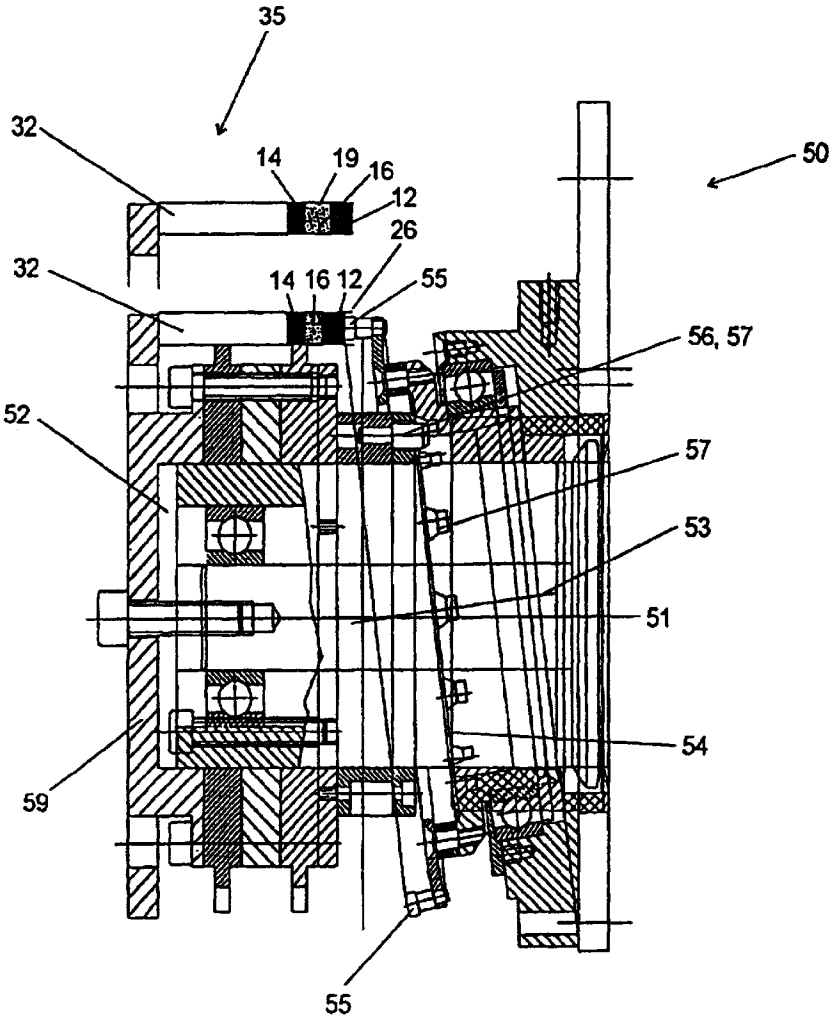

It is shown in:

FIG. 1 a cigarette 35 with a filter 10,

FIG. 2 an example of a single filter 10, in which the first terminal filter element 12 is a concentric filter with an advanced internal core 25 and an outer ring 24, FIG. 3 an example of a device 40 for example for carrying out a process according to the invention, FIG. 4 an alternative version of the device 40 and FIG. 5 an example of a device 50 for carrying out a further process according to the invention.

FIG. 1 shows a cigarette 35 with a filter 10. The filter element 12 which is cut in the middle into two parts approximately along its longitudinal axis, one of the parts being displaced towards the central filter element 16, is to be seen at the mouth-side end of the filter 10. It is furthermore to be seen that the two parts of the filter element 12 form a slight bulge at the projecting ends, which impede a return movement into the starting position. The central filter element 16 is completely filled with activated carbon 17. The second filter element 14 is located connected thereto. The filter elements 12 and 14 are wrapped in a wrapping 22 of porous casing paper with approx. 10000 Coresta units. The filter 10 as a whole is surrounded by a casing 20, which is likewise made of porous casing paper with approx. 10000 Coresta units. This filter 10 is combined with a tobacco column 32, the second terminal filter element 14 bordering this tobacco column 32. The filter 10 is connected to the tobacco column 32 via the lining sheet 34. Alternatively a similar cigarette could be obtained by combining the tobacco column 32 with the filter 10 of FIG. 2 below.

FIG. 2 shows a filter 10 which, in addition to a second terminal filter element 14 and its wrapping 22, which is securely connected to an outer casing 20, has a middle filter element 16 which is completely filled with activated-carbon particles 17. In the case of the filter 10 of FIG. 2, the compression of the activated-carbon particles 17 has taken place via the tobacco-side concentric filter with the outer ring 24 and the internal displaceable core 25. A cavity 26 thereby forms in turn. The outer ring 24 is formed by an acetate filter in the example of FIG. 2 and it can be seen that, after the advancing of the core 25, the projecting part of the ring 24, which was previously lying under pressure against the core 25, expands inwards towards the recess 26 and thereby forms a bulge which, in addition to the friction between the core 25 and the ring 24, prevents the opposite movement of the core 25 back into its starting position. The second terminal filter element 14 is somewhat longer than the first, and both are clearly longer than the middle filter element 16. Thus 41% of the overall length of the filter is accounted for by the second terminal filter element 14, 35% by the first one 12 and 24% by the middle one 16.

FIG. 3 shows a device 40 which first has a drum 42 which has several double filters 31, only two of which are schematically outlined here on its circumference, the first terminal filter elements of which are displaceable. Two solid disks 44 are provided to the right and the left of the central drum 42. It can be seen that the rotational axis of the solid disks is slightly inclined vis-à-vis the rotational axis of the drum 42, with the result that during the synchronous rotation of drum 42 and disks 44, the tampers 45 on the circumference of the solid disks 44 move towards and away again from the drum. Represented at the top of FIG. 7 is the smallest distance between two disks 45 of the opposite-facing disks and the dipping of the tampers 45 into the double filter 31, whereby the first terminal filter elements 12, not shown here, are pushed forward. (Naturally, opposite-facing tampers of the disks are congruent and are not arranged offset). During the further movement of drum 42 and disks 44, the tampers 45 move slowly out of the double filter 31 again until they reach their greatest distance apart, shown at the bottom of FIG. 3. At this point, the double filter 31 with the first terminal filter elements 12 now pushed forward can be transferred to a further drum so that the next process steps, in particular the supply of an unprocessed double filter, can take place.

The two solid disks 44 of FIG. 3 have recesses 47, the drum 42 projections 46. Upon the rotary movement of drum 42 and disk 44, the projections 46 engage as can be seen in FIG. 3 in the corresponding recess 47. During the further movement of the drum 42, a single projection 46 will slowly emerge from a recess 47, due to the angle of inclination of the rotational axis of the drum relative to the rotational axis of the disk, and a following projection 46 on the drum 42 will engage in a following recess 47 and the rotary movement of the disk 44 will continue.

An alternative version 40 is represented in FIG. 4. The essential difference from the device 40 of FIG. 3 is that, instead of the solid disk 44, a spring leaf 48 now carries the tampers 45. This makes possible a slight axial elasticity of the tampers at the moment of the advancing of the first terminal filter element and can therefore prevent possible damage to the casing and the filter elements.

FIG. 5 shows a device 50 for displacing a first terminal filter element 12 in a cigarette 35. There can be seen the drum 52 which can carry at its circumference several cigarettes 35, each with a first terminal, mouth-side filter element 12, a middle filter element 16 and a second terminal filter element 14, which is next to a tobacco rod 32, only one of these cigarettes 35 being shown in FIG. 5. The retaining device 59, which is a disk 59 arranged coaxially to the rotational axis 51 of the drum 52, can be seen to the left beside the drum 52. A disk 54, inclined relative to the rotational axis 51 of the drum 52, is shown with its rotational axis 53 to the right beside the drum 52. The disk 54 carries several tampers 55, and in FIG. 5 at the top the smallest distance between a tamper 55 and the retaining disk 59 is shown, so that the advancing of the mouth-side, first terminal filter element 12 is already completed. As a comparison, at the top of FIG. 5 the cigarette 35 is shown before the compression of the activated carbon in the middle chamber 16. It can be seen that a clear reduction in volume of the internal chamber 16 takes place, and the filter-material-free channel 19 disappears after the compression.

The disk 54 is, in a similar manner to the device 40 of FIGS. 7 and 8, again driven via projections 56 which engage in corresponding recesses 57, so that the disk 54 is driven simultaneously via the rotary movement of the drum 52.

The invention claimed is:

1. A process for producing a filter strand (31) comprising two or more filters (10) each including a first end filter element (12, 24, 26), a second inside filter element (14), a middle filter element (16) containing granular filter material (17) and located between the first and second filter elements, and an outside casing (20) surrounding all of the filter elements, the process comprising the steps of exerting force on the first end filter element (12, 24, 26) from outside the filter strand (31) in order to inwardly displace at least a portion of the first end filter element (12, 24, 26) relative to the casing (20) toward and against the middle filter element (16), to thereby compress the granular filter material (17) therein, and wherein each first end filter element (12, 24, 26) includes an outer ring (24) and an internal core (25), and wherein the internal core (25) is displaced inwardly against the granular filter material (17).

2. A process for producing a filter strand (31) comprising two or more filters (10) each including a first end filter element (12, 24, 26), a second inside filter element (14), a middle filter element (16) containing granular filter material (17) and located between the first and second filter elements, and an outside casing (20) surrounding all of the filter elements, the process comprising the steps of exerting force on the first end filter element (12, 24, 26) from outside the filter strand (31) in order to inwardly displace at least a portion of the first end filter element (12, 24, 26) relative to the casing (20) toward and against the middle filter element (16) to thereby compress the granular filter material (17) therein, and wherein each first filter end element (12, 24, 26) includes at least two pieces (12, 26) one of which is displaced inwardly against the granular filter material (17).

3. A process as in claim 1 including the step of preventing return of the inwardly displaced portion of the first filter element (12, 24, 26) after inward displacement thereof through friction and interference between the outer ring and the inner core.

4. A process as in claim 2 including the step of preventing return of the inwardly displaced portion of the first filter element (12, 24, 26) after inward displacement thereof through friction and interference between the two pieces.

* * * * *